US007594649B2

(12) United States Patent
Liu et al.

(10) Patent No.: US 7,594,649 B2
(45) Date of Patent: Sep. 29, 2009

(54) PAPER GRABBING ASSEMBLY

(75) Inventors: Jen-Chieh Liu, Danshuei Township (TW); Chun-Liang Liu, Banciao (TW)

(73) Assignee: Lite-On Technology Corporation, Taipei (TW)

( * ) Notice: Subject to any disclaimer, the term of this patent is extended or adjusted under 35 U.S.C. 154(b) by 32 days.

(21) Appl. No.: 11/611,754

(22) Filed: Dec. 15, 2006

(65) Prior Publication Data

US 2007/0262515 A1 Nov. 15, 2007

(30) Foreign Application Priority Data

May 12, 2006 (TW) ..... 95208212 U

(51) Int. Cl.
*B65H 3/06* (2006.01)

(52) U.S. Cl. ..... 271/116; 271/117; 271/127

(58) Field of Classification Search ..... 271/167, 271/117, 118, 116, 126, 127, 156
See application file for complete search history.

(56) References Cited

U.S. PATENT DOCUMENTS 4,717,139 A * 1/1988 Sootome et al. ..... 271/116
5,863,036 A * 1/1999 Tanaka et al. ..... 271/10.11
5,909,872 A * 6/1999 Takahashi ..... 271/116
5,984,297 A * 11/1999 Tanaka ..... 271/118
7,222,847 B2 * 5/2007 Yamamoto ..... 271/153
2002/0003332 A1 * 1/2002 Hiratani ..... 271/121
2006/0255530 A1 * 11/2006 Ma ..... 271/126
2007/0001376 A1 * 1/2007 Lim et al. ..... 271/121
2007/0063423 A1 * 3/2007 Kirby ..... 271/126

FOREIGN PATENT DOCUMENTS

JP 05301644 A * 11/1993
TW 536517 10/1991

* cited by examiner

*Primary Examiner*—Kaitlin S Joerger
(74) *Attorney, Agent, or Firm*—Workman Nydegger

(57) ABSTRACT

A paper grabbing assembly is provided. The paper grabbing assembly includes: a base with a pivot seat disposed thereon, wherein the shaft is pivotally disposed on the pivot seat; a bearing plate, pivotally disposed on the base corresponding to the paper grabbing roller; a driven member, connected to one end of the shaft; a cam member and an elastic member, rotatablely fitted on the shaft. The elastic member frictionally contacts the cam member and the driven member respectively, such that the driven member rotates the cam member via the elastic member, for pressing the bearing plate away from the paper grabbing roller. Further, when the cam member is stopped, the elastic member slides relative to the cam member, such that the driven member may not be affected by the cam member, but continue driving the paper grabbing roller to rotate.

7 Claims, 4 Drawing Sheets

PAPER GRABBING ASSEMBLY

CROSS-REFERENCE TO RELATED APPLICATIONS

This non-provisional application claims priority under 35 U.S.C. § 119(a) on Patent Application No(s). 095208212 filed in Taiwan, R.O.C. on May 12, 2006, the entire contents of which are hereby incorporated by reference.

BACKGROUND OF THE INVENTION

1. Field of Invention

The present invention relates to a paper feeding apparatus, and more particularly to a paper grabbing assembly adapted for a paper feeding apparatus.

2. Related Art

Automatic paper feeding mechanism has been widely used in multi-function peripherals, such as photocopiers, printers, or fax machines, mainly for transferring required paper piece by piece to the next sub-apparatus for further processing.

A transfer mechanism for transferring paper, especially used to stably transfer paper piece by piece for avoiding a paper jam, is the key direction of the current research and development in the field. As for related arts of a paper transferring apparatus, for example, Taiwan Patent Publication No. 536,517 published on Jun. 11, 2003 discloses an automatic paper feeding mechanism. In above-mentioned patent, when the second driving device of the automatic paper feeding mechanism is initiated, the lifting lever device lifts the paper in a paper-storage box to contact the paper grabbing roller. A paper-separating roller is drawn close to and contacts the paper feeding roller. Next, the first driving device drives the paper grabbing roller to fetch the paper within the paper-storage box. Then, the paper is driven by the paper feeding roller to move towards the paper feeding direction.

The conventional automatic paper feeding mechanism utilizes the lifting lever device disposed beneath the paper-storage box to lift or lower the paper in the paper-storage box, so as to make the paper close to or away from the paper grabbing roller. A first driving device is adopted to drive the paper grabbing roller, the paper feeding roller and the paper-separating roller. However, in order to make the automatic paper feeding mechanism separate and transfer paper smoothly, the lifting lever device, the first driving device and the second driving device must cooperate with each other to complete the process of separating, grabbing and feeding paper.

SUMMARY OF THE INVENTION

According to one aspect of the invention, a paper grabbing assembly is provided for simultaneously driving both the paper grabbing assembly and the paper grabbing roller with a simple structure.

To fulfill the above object, the paper grabbing assembly of the present invention is disposed at the inlet of a paper feeding apparatus corresponding to a paper grabbing roller, wherein the paper grabbing roller cooperates with the paper grabbing assembly to grab a piece of paper and transfer the paper into the paper feeding apparatus. The paper grabbing assembly comprises a base, a bearing plate, a shaft, a driven member, a cam member and an elastic member.

The base is disposed corresponding to the inlet of the paper feeding apparatus and has at least one pivot seat disposed thereon. The bearing plate is pivotally connected to the base corresponding to the paper grabbing roller for bearing paper.

One end of the shaft is pivotally connected to the pivot seat, and the paper grabbing roller is disposed on the shaft. The driven member is connected to the shaft to drive the shaft to rotate, so as to drive the paper grabbing roller to rotate. The cam member is rotatablely fitted on the shaft for being rotated to press the bearing plate away from the paper grabbing roller. The elastic member frictionally contacts the cam member and the driven member respectively, for transferring the rotation of the driven member to the cam member, so as to make the cam member press the bearing plate away from the paper grabbing roller. Additionally, when the cam member is stopped, the elastic member slides relative to the cam member, such that the driven member may not be affected by the cam member, but continue driving the paper grabbing roller.

The features and practice of the preferred embodiments of the present invention will be illustrated in detail below with the accompanying drawings.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus is not limitative of the present invention, and wherein.

DETAILED DESCRIPTION OF THE INVENTION

To further understand the objectives, structures, features and functions of the present invention, the present invention is described below in detail with reference to the embodiments.

Figure 1:
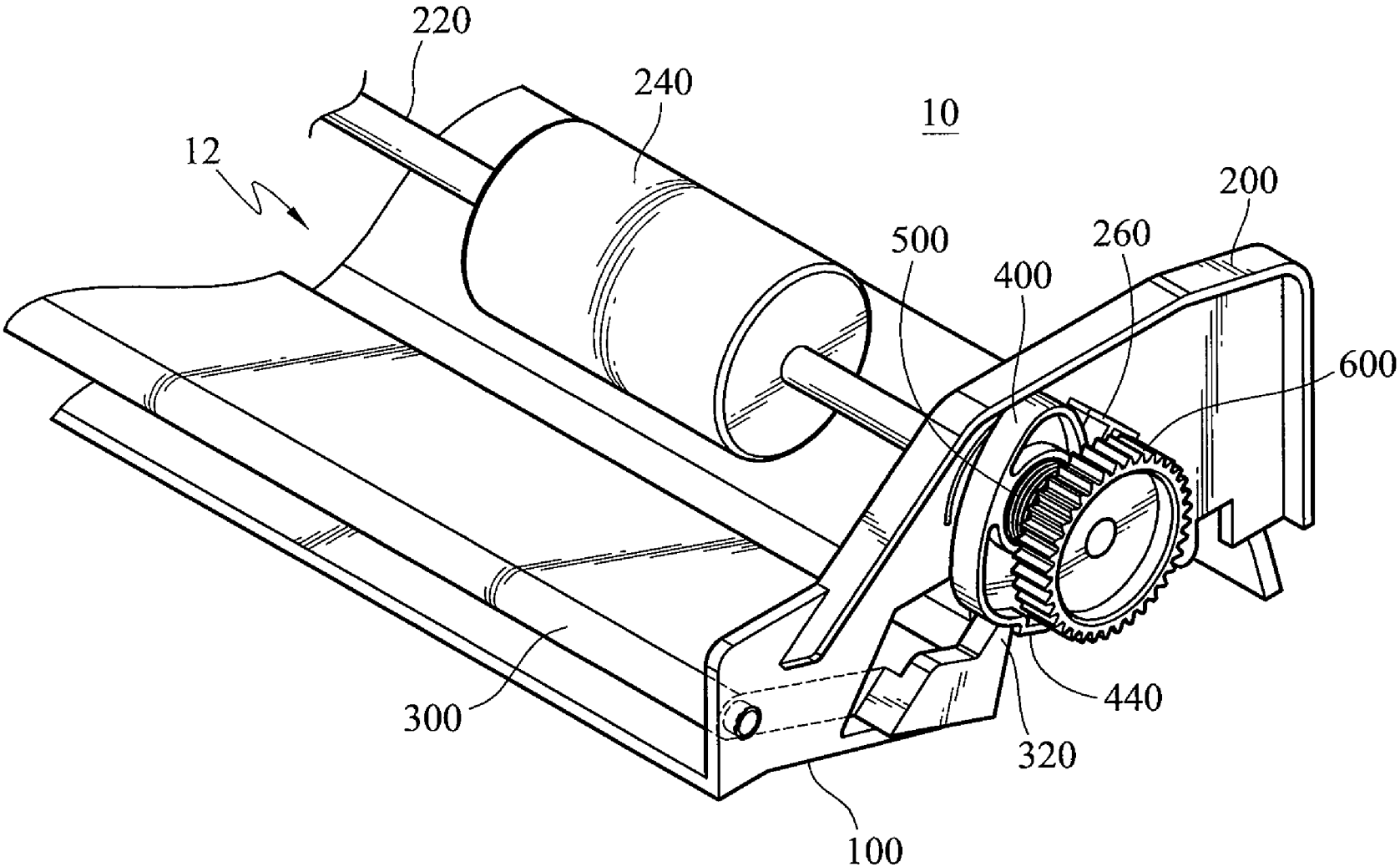
FIG. 1 is a stereogram of the appearance of a first embodiment of the present invention.

As shown in FIG. 1, it is a paper grabbing assembly disclosed by an embodiment of the present invention. The paper grabbing assembly is disposed at an inlet 12 of a paper feeding apparatus 10. The paper feeding apparatus can be, but not limited to, a printer, fax machine, scanner and multi-function peripheral. At the inlet of the paper feeding apparatus, a paper grabbing roller 240 is disposed at the inlet 12 of the paper feeding apparatus 10 for grabbing a piece of paper and then transferring the paper into the paper feeding apparatus 10. In the paper grabbing assembly disclosed by an embodiment of the present invention, a plurality of paper is sequentially grabbed by the paper grabbing roller 240 and then enters the paper feeding apparatus 10.

Figure 2:
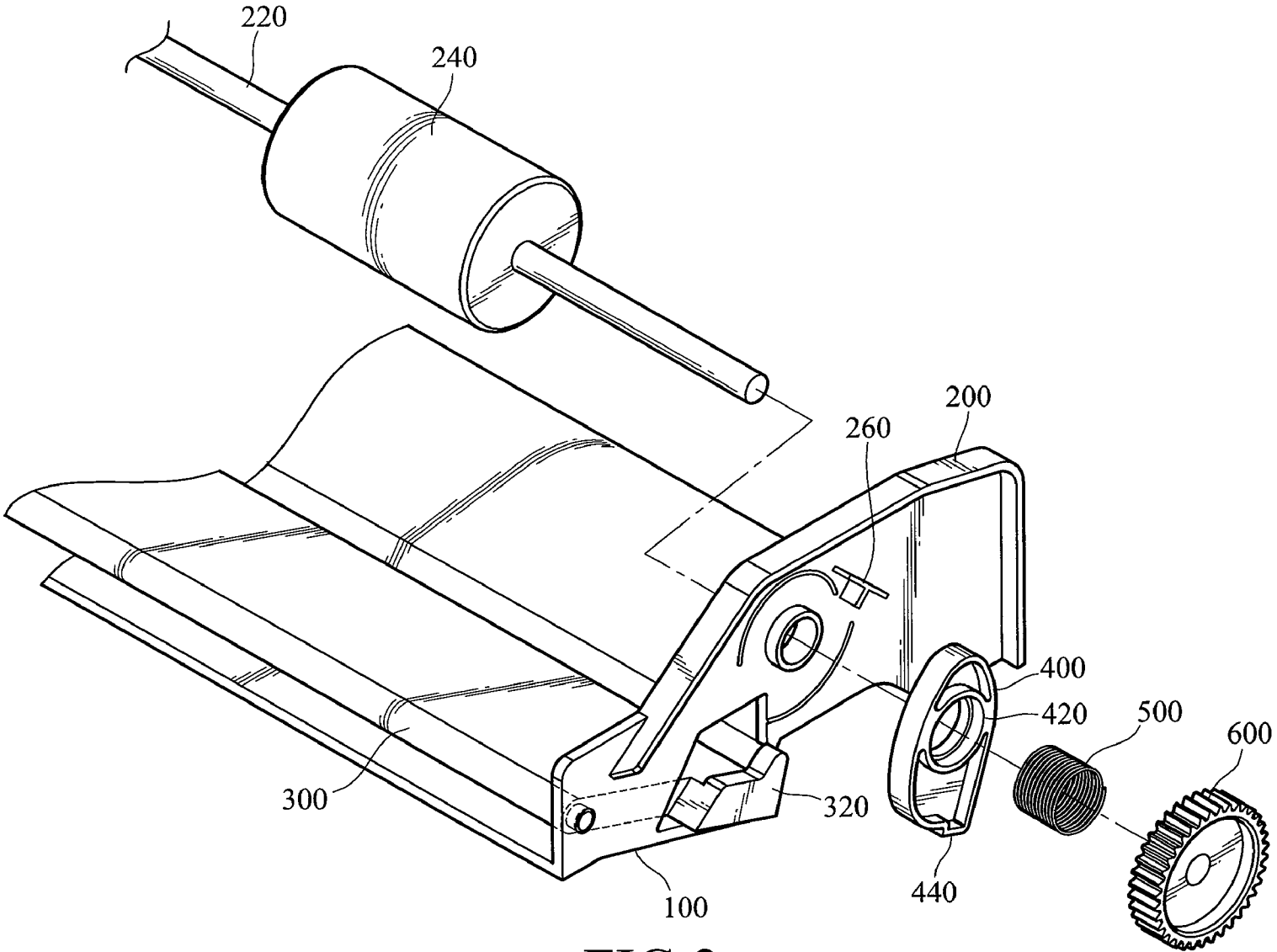
FIG. 2 is an exploded view of the first embodiment of the present invention.

As shown in FIGS. 1 and 2, the paper grabbing assembly in a first embodiment of the present invention comprises a base 100, a bearing plate 300, a shaft 220, a driven member 600, a cam member 400 and an elastic member 500.

The base 100 is disposed corresponding to the inlet 12 of the paper feeding apparatus 10 and has pairs of pivot seats 200 disposed thereon. Here, one pivot seat 200 is taken as an example for illustration, but the base 100 is not limited to forming only one pivot seat 200.

On end of the shaft 220 is pivotally connected to the pivot seat 200, and the shaft 220 passes through the axis center of the paper grabbing roller 240, such that the paper grabbing roller 240 is disposed across the inlet 12 of the paper feeding apparatus 10.

The bearing plate 300 is pivotally connected to the base 100 corresponding to the paper grabbing roller 240 for bearing the front edge of at least one piece of paper.

Referring to FIG. 2, it is the relative positions of the shaft 220, a driven member 600, an elastic member 500 and a cam member 400 disposed in the same axial line.

The driven member 600 and the shaft 220 are coaxially pivotally connected to the pivot seat 200, and connected to the shaft 220. The driven member 600 can be a driven gear coupled to a power source, for example, electric motor, for driving the shaft 220 to rotate.

Additionally, the shaft 220 is connected to the driven member 600 through the cam member 400 and the elastic member 500. The cam member 400 has a through hole 420 with an inner diameter larger than the outer diameter of the shaft 220, such that the shaft 220 passes through the through hole 420 of the cam member 400. Thus, the cam member 400 is movably and pivotally connected to the shaft 220. After being forced to rotate, the cam member 400 presses against the bearing plate 300 and pushes the free end of the bearing plate 300 away from the paper grabbing roller 240.

As the cam member 400 does not directly contact nor is directly connected to the driven member 600, in order to rotate the cam member 400, the elastic member 500 is pressed between the cam member 400 and the driven member 600 in an embodiment of the present invention, such that both ends of the elastic member 500 contact the cam member 400 and the driven member 600 respectively. Therefore, both ends of the elastic member 500 frictionally contact the cam member 400 and the driven member 600, so as to transfer the rotation of the driven member 600 to the cam member 400. When the driven member 600 begins rotating, the cam member 400 is rotated via the elastic member 500. In addition, the elastic member 500 may be a compression spring fitted to the shaft 220 with both ends frictionally contacting the cam member 400 and the driven member 600.

Furthermore, the cam member 400 must rotate with a limited angle, such that when downward pressing the bearing plate 300, the cam member 400 stops rotating for fear of departing from the bearing plate 300. Thus, a blocking part 320 protrudes from one side edge of the bearing plate 300 and extends towards the cam member 400, and a stopper 440 is disposed at the outer periphery of the cam member 400. After the bearing plate 300 is pressed downward to a predetermined position, the stopper 440 just stops the blocking part 320 to restrict the rotation of the cam member 400. If the driven member 600 still rotates at this moment, the elastic member 500 slides relative to the cam member 400, thereby preventing the cam member 400 from affecting the rotation of the driven member 600 and the shaft 220. The blocking part 320 further presses against the outer periphery of the cam member 400, for enlarging the rotation angle for the cam member 400 to push against the bearing plate 300. Therefore, the blocking part 320 can be disposed to reduce the size of the cam member 400. On the contrary, when rotating in another direction, the cam member 400 is forced to depart from the bearing plate 300, the paper grabbing roller 240 is driven by the shaft 220 to grab paper into the paper feeding apparatus 10. At this moment, the cam member 400 must be stopped after departing from the bearing plate 300. Thus, a limiting stopper 260 protrudes from a side surface of the pivot seat 200. When the cam member 400 reversely rotates for a predetermined angle, the limiting stopper 260 stops the stopper 440 of the cam member 400 for restricting the rotation of the cam member 400, such that the cam member 400 does not rotate any more. The driven member 600 rotates continuously for driving the paper grabbing roller 240 to grab paper and then continuously feed the paper into the paper feeding apparatus 10. When the stopper 440 presses against the limiting stopper 260, the elastic member 500 slides relative to the cam member 400, so as to prevent the cam member 400 from affecting the rotation of the driven member 600 and the shaft 220.

Figure 3A:
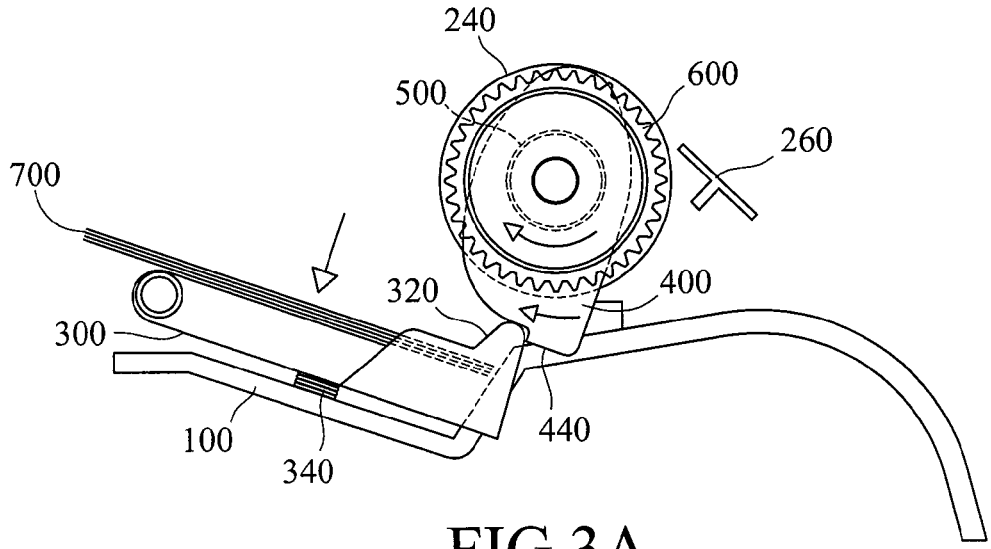
FIGS. 3A, 3B and 3C are views of the operation of the first embodiment of the present invention.
Figure 3B:
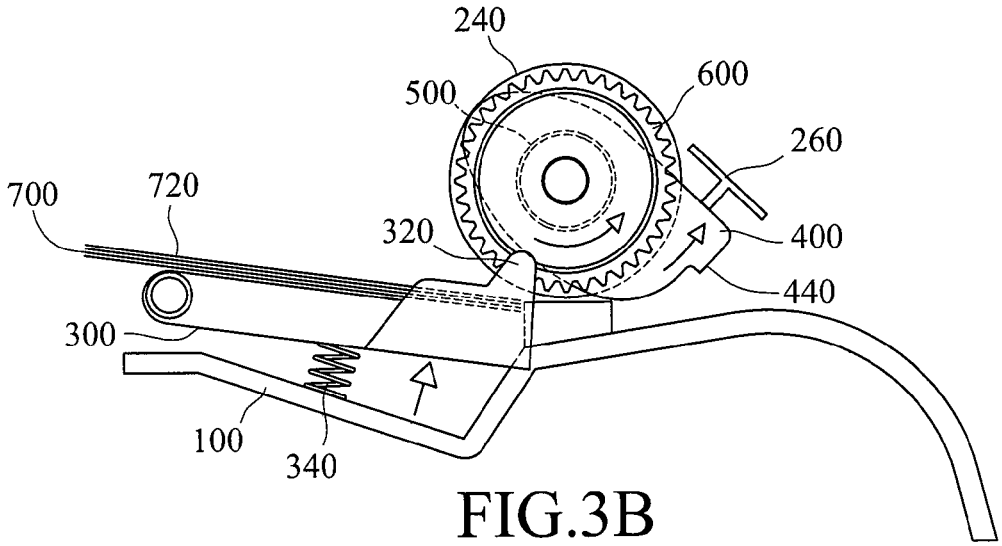
Figure 3C:
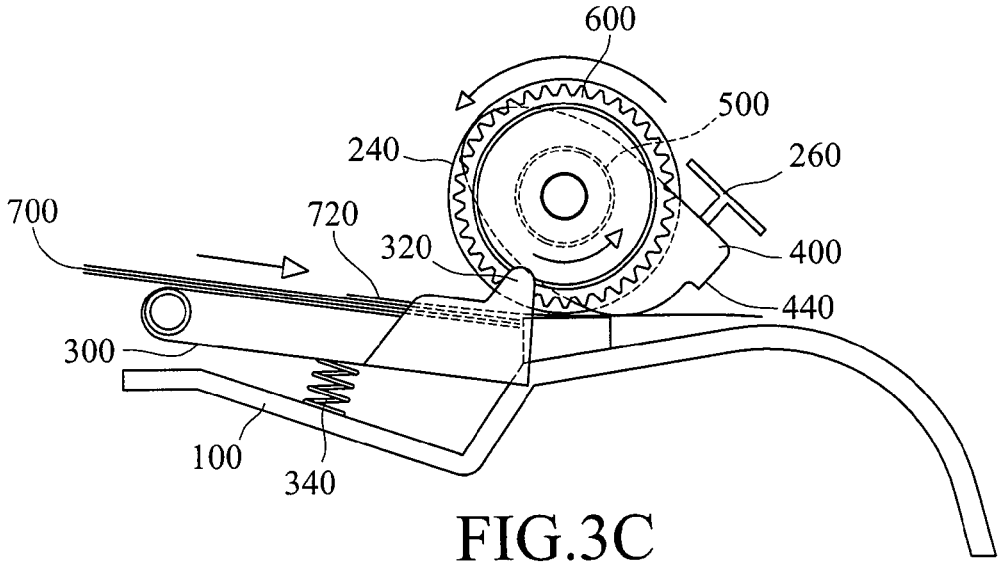

As shown in FIGS. 3A, 3B and 3C, they are schematic views of the operation of the first embodiment of the present invention.

In FIG. 3A, after being driven by a power source (not shown), the driven member 600 rotates in a clockwise direction as indicated by the arrow in the figure, and meanwhile the coaxial cam member 400 and the elastic member 500 are driven in the clockwise direction. The blocking part 320 at the side edge of the bearing plate 300 presses against the outer periphery of the cam member 400, such that when the cam member 400 rotates in the clockwise direction, the cam member 400 presses the bearing plate 300 downward. When the bearing plate 300 is pressed downward to the utmost extent, the stopper 440 of the cam member 400 is seized at the blocking part 320 for limiting the rotation angle of the cam member 400. After the bearing plate 300 has been pressed downward, the front edge of the paper 700 is lowered to beneath the paper grabbing roller 240.

In FIG. 3B, the driven member 600 driven by the power source (not shown) rotates in an anticlockwise direction as indicated by the arrow in the figure, and meanwhile the coaxial cam member 400 and the elastic member 500 are also driven to rotate in the anticlockwise direction. As the cam member 400 rotates in the anticlockwise direction, the blocking part 320 of the bearing plate 300 gradually bounces the bearing plate 300 back with a resetting element 340 disposed between the bearing plate 300 and the base 100. Due to the resetting of the bearing plate 300, a piece of paper 720 on top of the plurality of paper 700 contacts the paper grabbing roller 240. Further, as the paper grabbing roller 240 is rotated by the driven member 600, the paper grabbing roller 240 grabs the paper 720 that is to be fed. Then, the cam member 400 rotates in an anticlockwise direction till being stopped by the limiting stopper 260. As the driven member 600 rotates the cam member 400 via the elastic member 500, the elastic member 500 slides relative to the cam member 400 without affecting the rotation of the driven member 600. Therefore, the driven member 600 keeps on driving the paper grabbing roller 240 to rotate continuously in an anticlockwise direction, and the paper grabbing roller 240 continuously transfers the grabbed paper 720, as shown in FIG. 3C.

Figure 4:
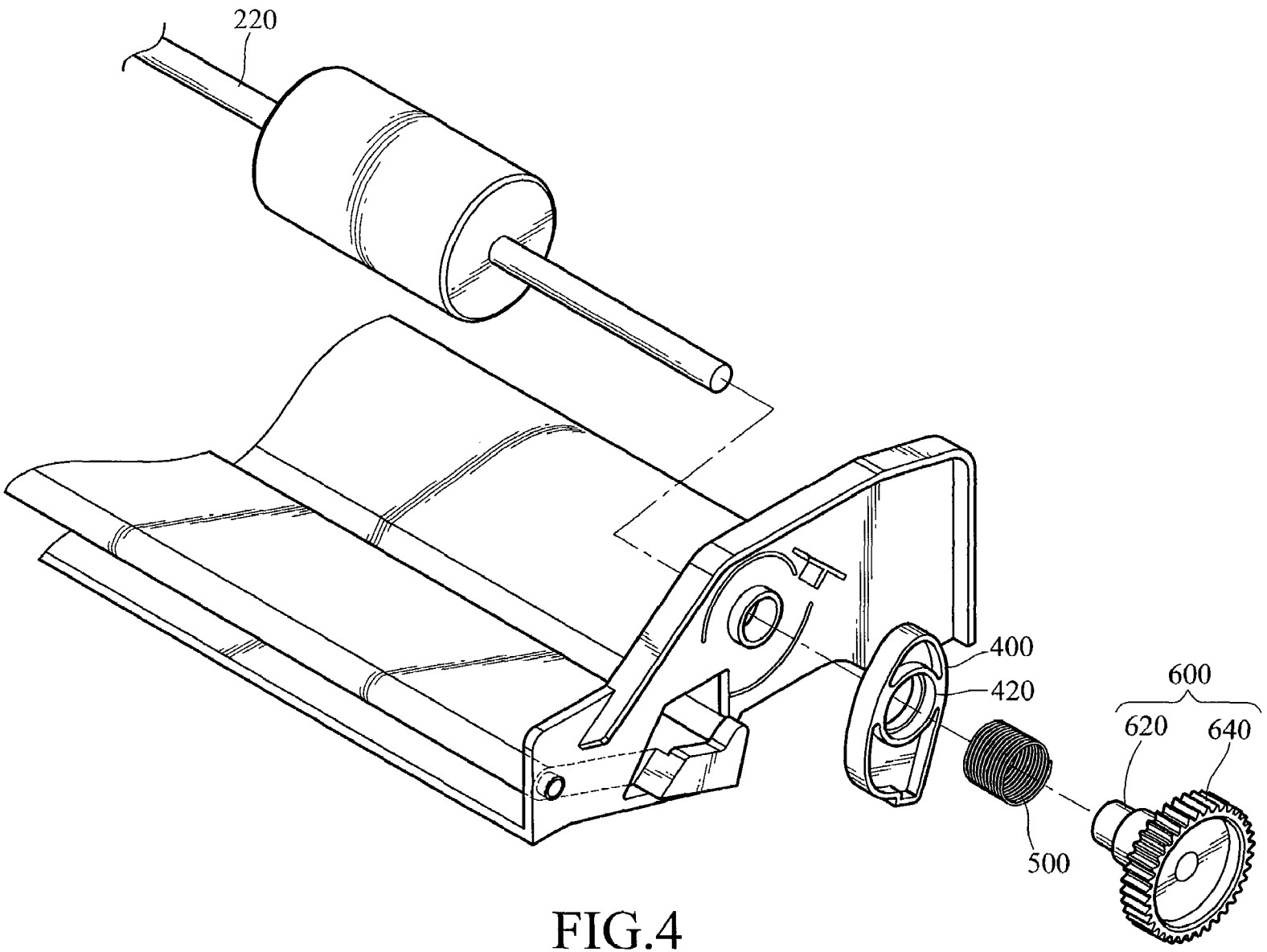
FIG. 4 is a stereogram of the appearance of a second embodiment of the present invention.

As shown in FIG. 4, it is a paper grabbing assembly according to a second embodiment of the present invention. The paper grabbing assembly is disposed at the inlet 12 of the paper feeding apparatus 10, and has a structure approximately the same as that of the first embodiment. However, the difference is that the driven member 600 comprises a driven part 640 and a sleeve part 620. The sleeve part 620 extends from a side surface of the driven part 640. The inner diameter of the through hole 420 of the cam member 400 is larger than the outer diameter of the sleeve part 620, such that the sleeve part 620 is fitted in the through hole 420 of the cam member 400. Thus, the cam member 400 is rotatablely fitted on the sleeve part 620. One end of the shaft 220 is connected to the sleeve part 620. The driven part 640 is a driven gear coupled to a power source. Further, the elastic member 500 is a compression spring fitted outside the sleeve part 620, wherein both ends of the elastic member 500 frictionally contact the cam member 400 and the driven part 640 respectively. The sleeve part 620 is fitted in the through hole 420 of the cam member 400, and the inner diameter of the through hole 420 is larger than the outer diameter of the sleeve part 620.

The efficacy of the present invention is that, the paper grabbing assembly can utilize a single power source to simultaneously drive both the paper grabbing roller and the paper grabbing assembly with a simple structure, and the operation of the paper grabbing roller may not be affected by the paper grabbing assembly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A paper grabbing assembly, disposed at an inlet of a paper feeding apparatus, wherein a paper grabbing roller is disposed at the inlet of the paper feeding apparatus for cooperating with the paper grabbing assembly to grab a piece of paper and then transfer the paper to the paper feeding apparatus, the paper grabbing assembly comprising:

a base correspondingly disposed at the inlet of the paper feeding apparatus with at least one pivot seat formed thereon;

a bearing plate pivotally connected to the base corresponding to the paper grabbing roller, for bearing the paper;

a shaft with one end pivotally connected to the pivot seat, wherein the paper grabbing roller is fixed on the shaft;

a driven member connected to the shaft for driving the shaft to rotate by a power source;

a cam member rotatablely fitted on the shaft, for being rotated to push the bearing plate away from the paper grabbing roller;

a blocking part formed at one side edge of the bearing plate which extends toward the cam member for pressing against the outer periphery of the cam member;

a stopper which protrudes from the outer periphery of the cam member which restricts the rotation of the cam member when it comes into contact with the blocking part;

a limiting stopper protruding from one side surface of the pivot seat which stops rotation of the cam member when the cam member comes into contact with the limiting stopper so as to restrict the rotation of the cam member; and an elastic member pressed between the cam member and the driven member, with one end of the elastic member frictionally contacting the cam member and the other end frictionally contacting the driven member so that the rotational force applied to the driven member by the power source is transferred to the cam member through the elastic member, such that the cam member rotates in association with the elastic member, except when the stopper contacts the limiting stopper of the pivot seat, and the end of the elastic member which frictionally contacts the cam member moves relative to the cam member.

2. The paper grabbing assembly as claimed in claim 1, wherein the cam member has a through hole, one end of the shaft is fitted in the through hole, and the inner diameter of the through hole is larger than the outer diameter of the shaft.

3. The paper grabbing assembly as claimed in claim 1, wherein the driven member has a driven part and a sleeve part, the sleeve part extends along a side surface of the driven part and is fitted in the through hole of the cam member, and the inner diameter of the through hole is larger than the outer diameter of the sleeve part.

4. The paper grabbing assembly as claimed in claim 3, wherein one end of the shaft is connected to the sleeve part.

5. The paper grabbing assembly as claimed in claim 3, wherein the driven part is a driven gear coupled to the power source.

6. The paper grabbing assembly as claimed in claim 3, wherein the elastic member is a compression spring fitted outside the sleeve part, with both ends frictionally contacting the cam member and the driven part respectively.

7. The paper grabbing assembly as claimed in claim 1, wherein the elastic member is a compression spring fitted outside the shaft, with both ends frictionally contacting the cam member and the driven member respectively.

* * * * *